US005232253A

United States Patent [19]

Tamiya

[11] Patent Number: 5,232,253

[45] Date of Patent: Aug. 3, 1993

[54] POWER-CLOSING LOCK DEVICE FOR VEHICLE DOOR

[75] Inventor: Mitsuru Tamiya, Tochigi, Japan

[73] Assignee: Mitsui Kinzoku Kogyo Kabushiki Kaisha, Tokyo, Japan

[21] Appl. No.: 961,870

[22] Filed: Oct. 15, 1992

[30] Foreign Application Priority Data

Oct. 15, 1991 [JP] Japan ..... 3-294935

[51] Int. Cl.[5] ..... E05C 3/06

[52] U.S. Cl. ..... 292/201; 292/280; 292/DIG. 43

[58] Field of Search ..... 292/201, 216, 280, 336.3, 292/DIG. 43

[56] References Cited

U.S. PATENT DOCUMENTS

| | | | |
|---|---|---|---|
| 3,999,791 | 12/1976 | Torii | 292/280 X |
| 4,746,153 | 5/1988 | Compeau et al. | 292/DIG. 43 X |
| 4,796,932 | 1/1989 | Tame | 292/DIG. 43 X |
| 4,892,339 | 1/1990 | Kleefeldt et al. . | |
| 4,892,340 | 1/1990 | Matumoto | 292/DIG. 43 X |
| 4,917,420 | 4/1990 | Rogers, Jr. | 292/DIG. 43 X |
| 5,020,838 | 6/1991 | Fukumoto | 292/201 |
| 5,046,341 | 9/1991 | Ogino et al. | 292/280 X |
| 5,118,146 | 6/1992 | Watanuki | 292/DIG. 43 X |

FOREIGN PATENT DOCUMENTS

| | | | |
|---|---|---|---|
| 3924230 | 2/1990 | Fed. Rep. of Germany | 292/201 |

*Primary Examiner*—Peter M. Cuomo
*Assistant Examiner*—Michael J. Milano
*Attorney, Agent, or Firm*—Browdy and Neimark

[57] ABSTRACT

A power-closing vehicle door lock device comprises a spring-returned latch rotatably mounted on a base plate and having a U-shaped groove for engaging a striker, a spring-returned ratchet rotatably mounted on the plate and engaged to the latch after the latch rotates to a closed-lid position thereby preventing the latch from rotating to an open-lid position, a pressing link slidably engaged to the latch for rotating the latch to the closed-lid position from the open-lid position, an open lever rotatably engaged to the ratchet for reliefing the ratchet from the latch and permitting the latch to rotate to the open-lid position, an actuator for moving the pressing link to rotate the latch into the closed-lid position when moving in a first direction and rotating the lever to permit the latch to rotate to the open-lid position when moving in a second direction, a manual-open handle connected to the lever, and a deformed oval opening formed in the lever so as to guide motion of the pressing link. The opening is made from a first guide for leading the pressing link until the latch rotates to the closed-lid position, and a second guide for leading the pressing link along a direction for making the pressing link leaved from the latch after the latch rotates to the closed-lid position.

3 Claims, 5 Drawing Sheets

POWER-CLOSING LOCK DEVICE FOR VEHICLE DOOR

FIELD OF THE INVENTION

The present invention relates to a power-closing lock device for a vehicle door, in particular to the lock device enabling to compulsorily rotate a latch by a reversible motor, adapted to engaged with a striker.

PRIOR ART

According to the conventional vehicle door lock device provided with a latch mechanism attached to the vehicle door and a striker attached to the vehicle body, the door is adapted to be held at its closed position after the door is pushed by hand and the moving door inertially makes the striker and the latch mechanism engaged with each other. When the door is shut with a very strong force or inertia, a unpleasant or strange sound is generated. On the contrary, when the door is shut with a weak force or insufficient inertia, the door may be shut incompletely.

Nowaday, in order to solve such problems above, a power-closing lock device for a vehicle door has been proposed, which device is adapted to have a latch compulsorily rotating by means of a motor after the door reaches its predetermined closed position, and a striker which catched by the latch attaining a complete-closed condition of the door.

However, the conventional power-closing lock device for a vehicle door cannot permit the vehicle door to open and shut by hand.

U.S. Pat. No. 4,892,339 discloses a power-close lock device provided with a manual open-shut mechanism for door. According to the conventional power-close lock device, a ratchet for preventing a latch of the lock device is rotatably attached to a triangular plate rotatably attached to a base plate, so that a whole construction of the lock device is simplified and, however, it is impossible to firmly hold the door. In detail, the triangular plate is held by only resistance force of the speed reduction mechanism for the motor, so that when an outside force along a door opening direction which is stronger than the resistance force is applied to the ratchet, the latch and the triangular plate rotate during the latch being engaged with the ratchet, resulting disadvantageously in an abrupt opening of the vehicle door.

SUMMARY OF THE INVENTION

Consequently, it is one of the purposes of the present invention to provide a power-closing lock device for vehicle door of a simple construction, enabling to open and close by hand, and to firmly hold the door at its closed position.

It is another purpose of the present invention to provide a power-closing lock device for vehicle door of a simple construction, enabling to open and shut with a simple manual operation corresponding to that of the conventional lock device.

PREFERRED EMBODIMENTS

Figure 1:
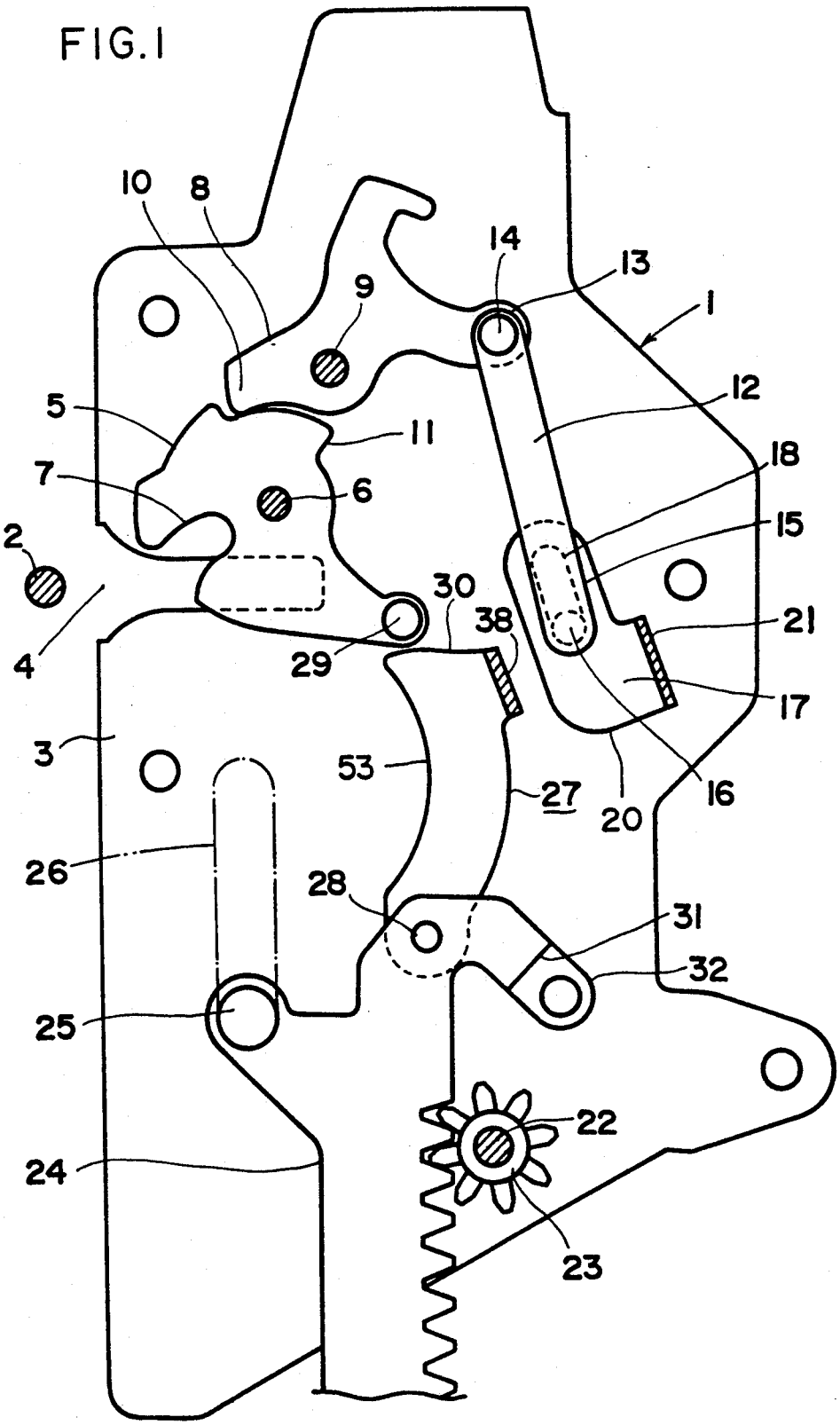
FIG. 1 is a longitudinal section side elevation of the lock main body, when it is open, of the present invention.

As shown in FIG. 1 to FIG. 5, the power-closing lock device for vehicle door according to the present invention has a lock main body 1 and a striker 2 fixed to ordinarily a trunk rid.

Apparently, the base plate 3 of the lock main body 1 has a shape of flat and has a notch 4 formed on a side of the flat plate, through which notch 4 the striker 2 enters or proceeds. About the notch 4 of the base plate 3, the latch 5 having a U-shape groove or dent 7 adapted to engage with the striker 2 is rotatably installed. The ratchet 8 is urged counterclockwise by a spring (not shown) and the latch 5 is prevented from reverse-rotating by an engagement of a claw portion 10 of the ratchet 8 and a stepped portion 11 of the latch 5.

Figure 2:
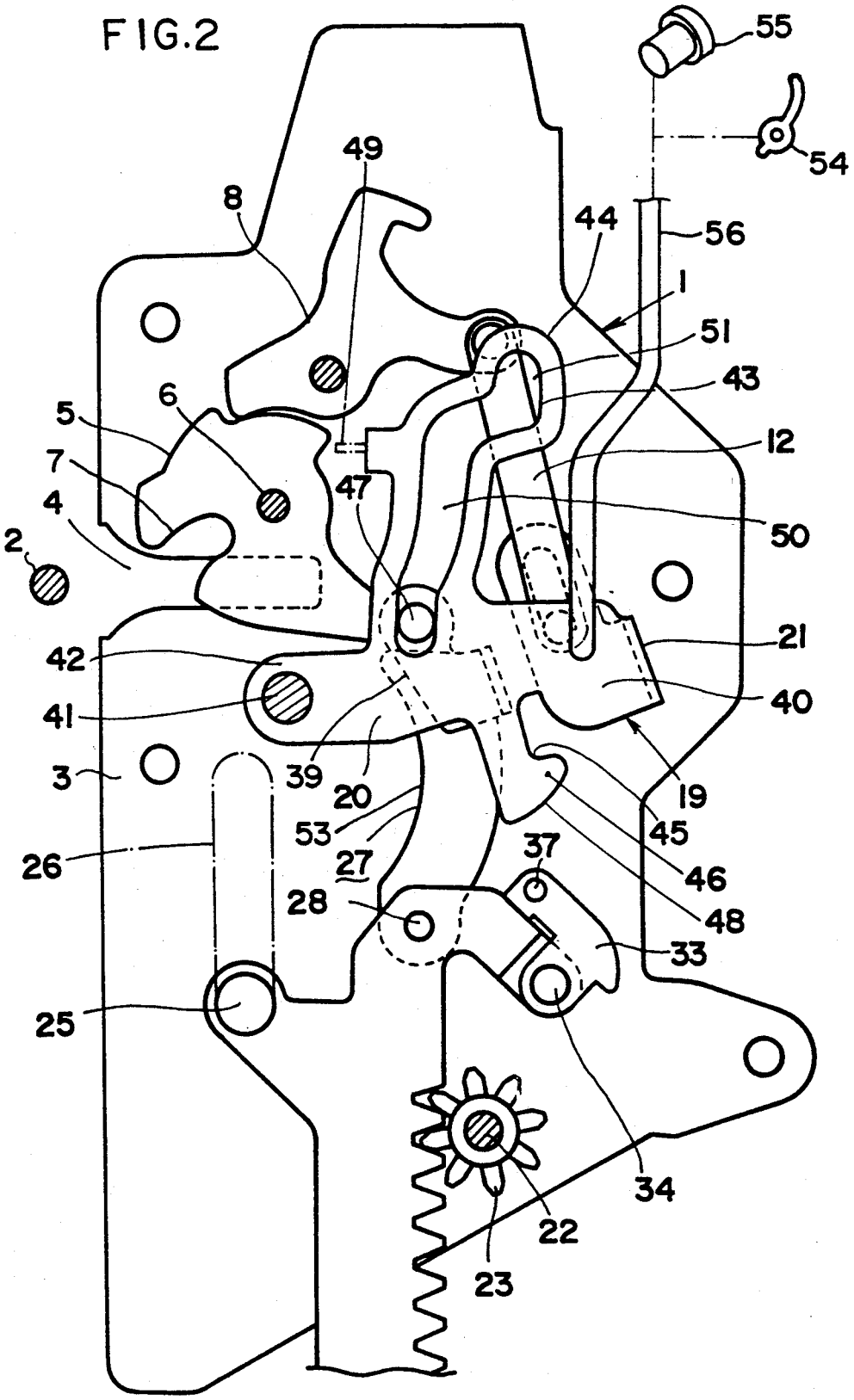
FIG. 2 is a similar view to FIG. 1 with different parts of the lock device shown, of the present invention.
Figure 3:
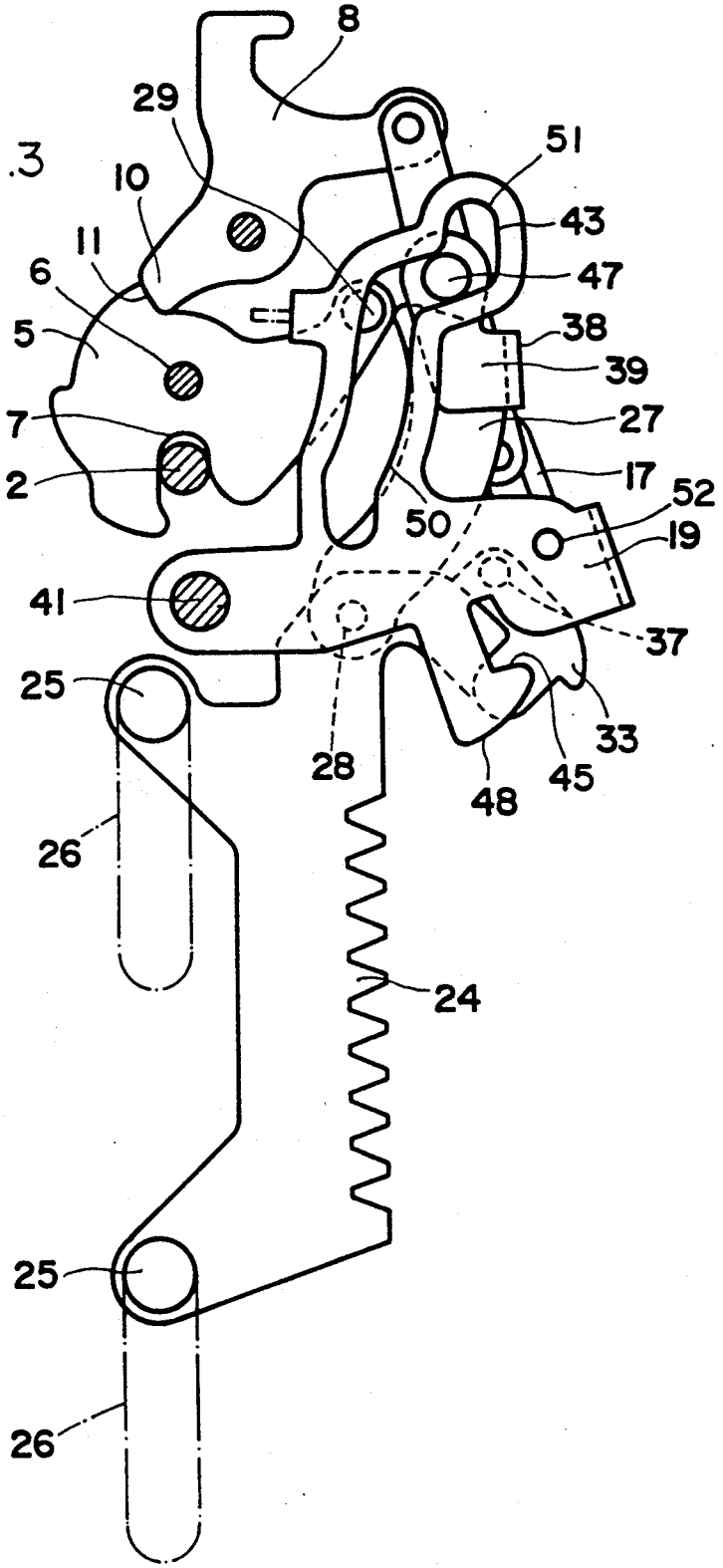
FIG. 3 is a side elevation showing an operative relation of the group of levers in the door-open condition.
Figure 4:
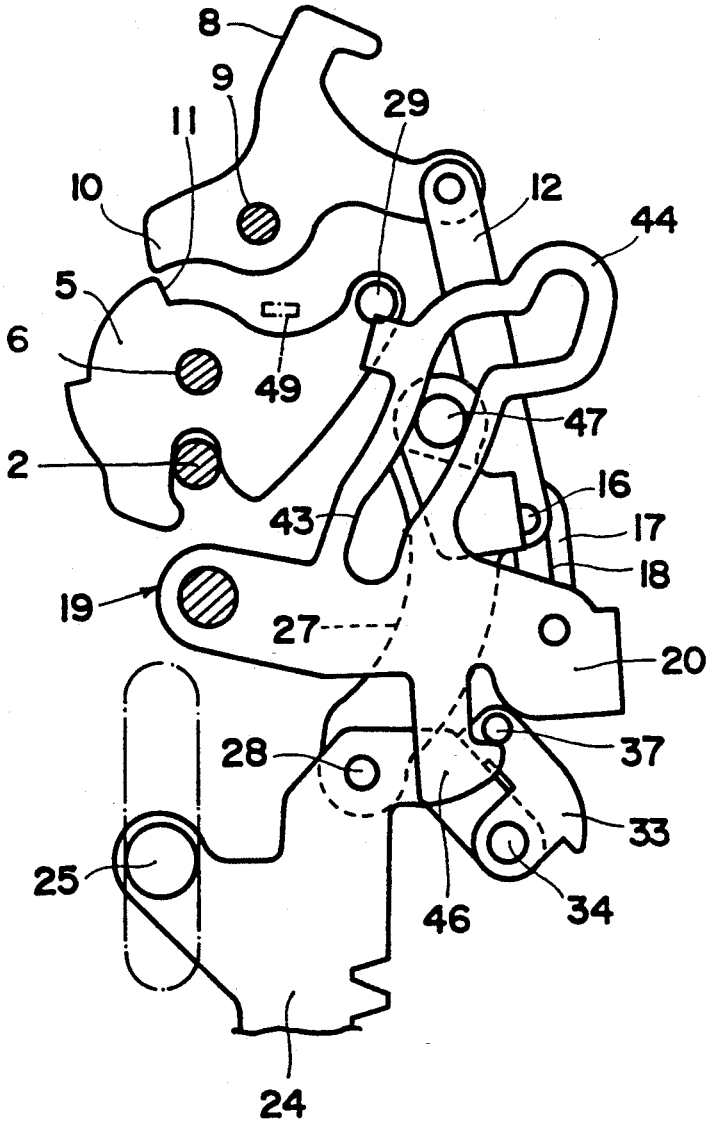
FIG. 4 is a side elevation depicting another operative relation of the levers in a mid-way condition toward opening the door.

An end 13 of a connecting rod 12 is connected to an end of the ratchet 8 by means of a pin 14. A pin 16 is planted on another end 15 of the connecting rod 12, which pin 16 being engaged with an oval opening 18 formed in a parallel member 17 of an open lever 19. The open lever 19 consists of, as shown in FIG. 2 depicting its whole construction, the parallel member 17, a base member 20 in parallel with the parallel member 17, and a side wall 21 connecting the base member 20 to the parallel member 17. A rod 56 is connected to a hole 52 of the base member 20 and extends to an open handle 54 in an interior of the vehicle or a key cylinder 55 of the trunk lid. When every parts or members of the lock device are placed as shown in FIG. 3, an operation of the open handle 54 or the key cylinder 55 makes the open lever 19 rotate clockwise around a center of a shaft 41 in order to lower the connecting rod 12 and, as a result, take off the ratchet 8 from the latch 5.

On the lower portion of the base plate 3, an output shaft 22 of an actuator (not shown) of the reversible motor and the like is arranged, on which output shaft 22 a pinion gear 23 being fixed. A rack rod or plate 24 extending vertically engages with the pinion gear 23. The rack plate 24 has a pair of guide pins 25 which being adapted to engage with a guide slit 26 extending in a direction of up-and-down and being formed in a cover plate (not shown). When the output shaft 22 of the actuator rotates, the rack plate 24 slides up-and-down while being guided by the guide slit 26. In addition, the actuator functions to push the rack plate 24 upward when the striker 2 enters in the notch 4 of the base plate 3 and engages with the glove 7 of the latch 5. When a door-opening switch (not shown) installed on the driver's seat is operated, the actuator functions to push down the rack plate 24.

A pressing link 27 is journalled to the upper portion of the rack plate 24 through a lower side of the pressing link by means of a pin 28. The pressing link 27 consists of a parallel member 39 placed in parallel to the base member 53, and a side wall 38 connecting the parallel member 39 and the base member 53. The upper end edge 30 of the base member 53 faces to a protrusion 29 of the latch 5. The protrusion 29 may be made of a hollow roller rotatably fixed by means of a round bar type pin or shaft. When the pressing link 27 moves upward by upward-movement of the rack plate 24, the upper end edge 30 of the base member 53 contacts with the protrusion 29 of the latch 5, thereby the latch 5 compulsorily rotates counterclockwise resisting a spring.

Figure 5:
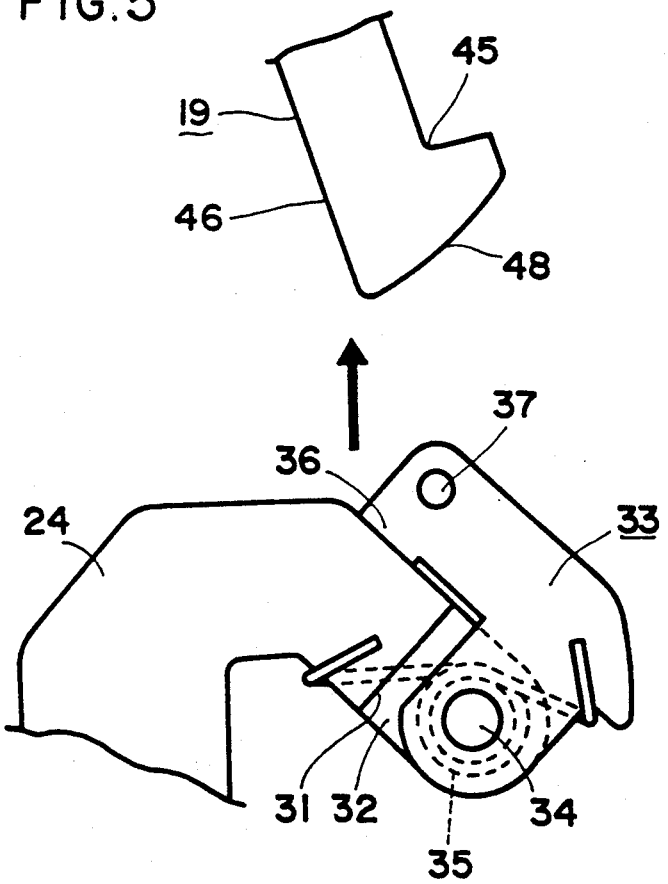
FIG. 5 is an enlarged view of the important parts of the lock device for vehicle door according to the present invention.

The rack plate 24 has an attachment piece or portion 32 bent toward the base plate 3 by a stepped portion 31. The attachment portion 32 is formed on the upper part of the rack plate 24. As shown in FIG. 2 and FIG. 5, the attachment portion 32 has a L-shaped lever 33 rotatably attached thereto by means of a pin 34. The L-shaped lever 33 is urged counterclockwise by means of a spring 35. The L-shaped lever 33 stops when an abutment 36 formed at a front end of the L-shaped lever 33 abuts with the rack plate 24. An engagement pin 37 is installed about the abutment 36.

The base portion 20 of the open lever 19 has four protruded portions or legs of a first leg portion 40 connected to the side wall 21, a second leg portion 42 rotatably fixed to a cover plate (not shown) through the shaft 41, a third leg portion 44 provided with a deformed oval opening 43, and a fourth leg portion 46 having a L-shape engagement portion 45. The open lever 19 is urged or pressed counterclockwise by means of a spring (not shown). The open lever 19 stops when it contacts with the protrusion 49 formed on the cover plate.

A pin 47 planted on the parallel member 39 of the pressing link 27 is engaged with the deformed oval opening 43 in order to guide the pressing link 27 while it moves up-and-down. As shown in FIG. 2, the deformed oval opening 43 consists of a first guide 50 extending along an arc of the shaft 6 of the latch 5, which arc being described around the shaft 6 when the open lever 19 contacts with the protrusion 49, and a second guide 51 connected to an end of the first guide 50. When the pin 47 on the pressing link 27 moves upward to an upper position of the first guide 50, the protrusion 29 abuts against the upper end edge 30 of the pressing link 27, so that the latch 5 rotates to a door-shutting position shown in FIG. 3. With a further upward motion of the pressing link 27, the pin 47 proceeds into the second guide 51 and the upper end edge 30 of the pressing link 27 is left from the protrusion 29 of the latch 5 as clearly shown in FIG. 3. As described above, in the door-shut condition, because the upper end edge 30 of the pressing link 27 is displaced from the protrusion 29 of the latch 5, it is possible to rotate clockwise the open lever 19 by operations of the open handle 54 or the key cylinder 55 without resistance and with smoothness.

As shown in FIG. 5, a front end of the fourth leg portion 46 has a tapered face 48. When the rack plate 24 moves upward, the engagement pin 37 of the L-shaped lever 33 abuts against the tapered face 48. When the tapered face 48 engages with the engagement pin 37, the L-shaped lever 33 escapes clockwise against a force of the spring 35 and climbs over the tapered face 48.

It is apparent that the lock device of the present invention is adapted to compulsorily rotate the latch 5 by means of a motor in order to open and shut the vehicle door. Consequently, it is necessary to install various electric switches on the lock device in order to detect positions and conditions of the latch 5, the rack plate 24 and the like. These electric switches are not included in the gist of the present invention, thereby any descriptions of such switches are omitted from the specification.

Next, operation of the lock device will be described.

When the striker 2 proceeds into the notch 4 of the base plate 3 and moves to a position at which position the striker 2 engages with the glove 7 of the latch 5 from the previous condition of the striker 2 shown in FIG. 1 and FIG 2 after the trunk lid is closed by hand, such present condition of the striker 2 is detected by a switch to actuate the actuator and the pinion gear 23 rotates. Then, the rack plate 24 moves upward and is guided by a guide slit 26, as well as the pressing link 27 moves upward and guided by the first guide 50 of the deformed oval opening 43.

When the pressing link 27 moves upward, the upper end edge 30 of the pressing link presses up the protrusion 29 and consequently the latch 5 compulsorily rotates counterclockwise so as to grip the striker 2. When the pin 47 of the pressing link 27 reaches a top position of the first guide 50, the latch 5 rotates to the door-closing position and the claw portion 10 of the ratchet 8 engages with the stepped portion 11 of the latch 5, thus the trunk lid is firmly held.

The pressing link 27 further moves upward after the latch 5 rotates to or reaches the door-closing position, and the pin 47 of the pressing link 27 enters into the crank-like second guide 51 from the first guide 50. As a result, the upper end edge 30 of the pressing link 27 is led as shown in FIG. 3 along a direction that the upper end edge 30 leaves the protrusion 29 of the latch 5. As described above, after the vehicle door is shut, the latch 5 is firmly held at its door-closing position by the ratchet-own strength and the upper end edge 30 of the pressing link 27 leaves a rotary track of the protrusion 29 of the latch 5. In addition, in such motion of the pressing link 27, its upper end edge 30 smoothly slides and leaves because the protrusion 29 is made of a round pin or hollow roller.

When the rack plate 24 moves upward, the engagement pin 37 of the L-shaped lever 33 abuts against the tapered face 48 of the open lever 19, the L-shaped lever 33 escapes and moves clockwise against resilient force of the spring 35. When the L-shaped lever 33 climbs over the tapered face 48, the L-shaped lever 33 returns to its original position due to resilient force of the spring 35.

Next, in order to open the door, pushing a door-open switch installed in the driver's seat reversely rotates the pinion gear 23, thus the rack plate 24 downs. Then, the engagement pin 37 of the L-shaped lever 33 attached to the rack plate 24 engages with a L-shaped engagement portion 45 of the open lever 19, thereby the L-shaped engagement portion 45 downs. Consequently, the open lever 19 clockwise rotate around the shaft 41 and the ratchet 8 connected to the open lever 19 through the connecting rod 12 clockwise rotates, thus the claw portion 10 of the ratchet 8 is made left from the stepped portion 11 of the latch 5 and the latch 5 is made free making the striker 2 free. Additionally, an engagement of the engagement pin 37 with the L-shaped engagement portion 45 is cancelled when the open lever 19 rotates by the predetermined volume. By the way, the open lever 19 returns to the position shown in FIG. 1 by a resiliency of the spring.

When the actuator is broken and the vehicle door must be open by hand, it is sufficient to push the trunk lid with a manual force stronger a little than that of usual. When various parts of the lock device of the present invention are placed or positioned as shown by FIG. 1 and the trunk lid is pressed with a force a little stronger than that of usual, the striker 2 enters into the glove 7 of the latch 5 so as to rotate the latch 5 to its door-closing position. Then, as well known, the claw portion 10 of the ratchet 8 engages with the stepped portion 11, so that the latch 5 is firmly held.

On the contrary, when the door is open by hand, the open handle 54 or the key cylinder 55 is operated and the open lever 19 rotates clockwise around the shaft 41 in order to rotate clockwise the ratchet 8 through the connecting link 12 and left or disengage the claw portion 10 of the ratchet 8 from the stepped portion 11 of the latch 5. Because the upper end edge 30 of the pressing link 27 is previously guided by the second guide 51 and displaced from the rotary track of the protrusion 29 of the latch 5, no additional resistance is applied to the open handle 54 or the key cylinder 55 when it operates, so that it is possible to handle it without difficulty.

Additionally, even when the upper end edge 30 of the pressing link 27 and the protrusion 29 of the latch 5 are kept at an abutment condition during the manual door opening operation mentioned above, an engagement of the deformed oval opening 43 and the pin 47 rotates the open lever 19 and consequently the upper end edge 30 of the pressing link 27 is displaced sideward from the rotary track of the protrusion 29 of the latch 5, so that no interference in rotation of the latch 5.

What is claimed is:

1. A power-closing vehicle door lock device comprising:

a spring-returned latch rotatably mounted on a base plate and having a U-shaped groove for engaging a striker of said lock device;

a spring-returned ratchet rotatably mounted on said base plate and engaged to said latch after said latch rotates to a closed-lid position thereby preventing said latch from rotating to an open-lid position;

a pressing link slidably engaged to said latch for rotating said latch to said closed-lid position from said open-lid position;

an open lever rotatably engaged to said ratchet for relieving said ratchet from said latch and permitting said latch to rotate to said open-lid position;

actuator means for moving said pressing link to rotate said latch into said closed-lid position when moving in a first direction and rotating said open lever to permit said latch to rotate to said open-lid position when moving in a second direction;

a manual-open handle connected to said open lever; and a deformed oval opening formed in said open lever so as to guide motion of said pressing link, wherein said deformed oval opening is made from a first guide for leading said pressing link until said latch rotates to said closed-lid position, and a second guide for leading said pressing link along a direction for making said pressing link leave from said latch after said latch rotates to said closed-lid position.

2. A power-closing vehicle door lock device according to claim 1, wherein a round bar-like pin is attached to said latch and said pressing link is adapted to engage with said pin in order to rotate said latch.

3. A power-closing vehicle door lock device according to claim 1, wherein a hollow roller is attached to said latch and said pressing link is adapted to engage with said hollow roller in order to rotate said latch.

* * * * *